United States Patent [19]

[11] 4,099,933

[45] Jul. 11, 1978

Johnson et al.

[54] PROCESS FOR THE MULTIPLE ZONE GASIFICATION OF COAL

[75] Inventors: Clarence A. Johnson, Princeton, N.J.; John Shen, Gaithersburg, Md.

[73] Assignee: Hydrocarbon Research, Inc., Lawrenceville, N.J.

[21] Appl. No.: 585,696

[22] Filed: Jun. 10, 1975

Related U.S. Application Data

[63] Continuation-in-part of Ser. No. 365,910, Jun. 1, 1973, abandoned.

[51] Int. Cl.[2] ..... C10J 3/54

[52] U.S. Cl. ..... 48/202; 48/206; 48/DIG. 4; 201/9

[58] Field of Search ..... 48/197 R, 202, 203, 48/206, 210, DIG. 4, 204; 201/9, 31, 38; 202/121

[56] References Cited

U.S. PATENT DOCUMENTS

| | | | |
|---|---|---|---|
| 2,131,702 | 9/1938 | Berry | 48/210 |
| 2,579,397 | 12/1951 | Roetheli | 48/206 |
| 2,588,076 | 3/1952 | Gohr | 48/DIG. 4 |
| 2,591,595 | 4/1952 | Ogorzaly | 48/206 |
| 2,633,416 | 3/1953 | Gornowski et al. | 48/203 |
| 2,683,657 | 7/1954 | Garbo | 48/202 |
| 2,772,954 | 12/1956 | Jequier | 48/202 |
| 3,740,204 | 6/1973 | Slater et al. | 48/210 |
| 3,746,522 | 7/1973 | Donatl | 48/210 |
| 3,817,723 | 6/1974 | Donatl | 48/206 |

OTHER PUBLICATIONS

Kirk-Othmer Encyclopedia of Chemical Technology, *Second Edition, Supplemental Volume, 1971, pp. 186–188.*

"Some Relations in Rank and Rate of *Heating to Carbonization Properties of Coal*", J. S. Delhunty and B. L. Harrison, Fuel, 32 (1953).

Clean Fuels from Coal Symposium, "Present Status of the H-Coal Process", Johnson et al; Inst. of Gas Technology, Sep. 1973.

*Primary Examiner*—S. Leon Bashore
*Assistant Examiner*—Peter F. Kratz
*Attorney, Agent, or Firm*—Michael A. Jacobs

[57] ABSTRACT

The gasification of coal to produce a methane-rich product gas is accomplished through the controlled slow heating of particulate coal in a gasifier comprising two or more zones, whereby any significant decrease in the density of the coal particles is minimized and particle swelling and friability are significantly reduced, while the carryover of fines and deposition of tars in the product gas conduit are thereby minimized. The particulate coal heating rate in the gasifier zones is usually between about 10° and 200° F per minute. When the particulate coal is to be fed to the gasifier at elevated temperature, further improvements are achieved with swelling type caking coals through their pretreatment by preheating the coal at a slow rate between 10° and 100° F per minute up to about 800° F in multiple fluidized beds. Any carryover of fines in the product gas stream from the uppermost zone of the gasifier is further reduced by utilizing either a solids separation step or a scrubbing step in the gas stream. The coal particles and/or tars thus recovered are returned to a high temperature zone of the gasifier.

10 Claims, 2 Drawing Figures

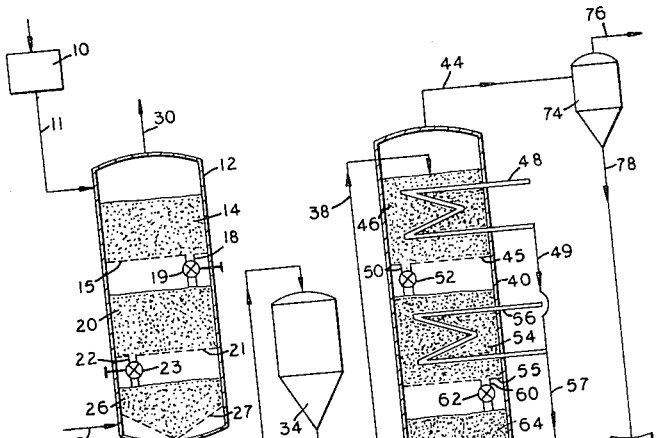

PROCESS FOR THE MULTIPLE ZONE GASIFICATION OF COAL

CROSS REFERENCE TO RELATED APPLICATION

This present application is a continuation-in-part of copending U.S. patent application Ser. No. 365,910, now abandoned filed June 1, 1973, entitled "COAL GASIFICATION".

BACKGROUND OF THE INVENTION

The gasification of particulate coal in a fluidized bed is known, having been disclosed by Garbo in U.S. Pat. Nos. 2,683,657 and 2,729,597, and by Forney in U.S. Pat. No. 3,463,623. In these patents, the particulate coal, on entering the gasification zone, is heated very quickly to the gasification temperature. Such rapid heating of the coal causes a decrease in coal density and also the coal particles structure is weakened. This results in the breaking up of coal particles in the gasifier to form low density fines. The decrease in coal density is a result of the coal particles undergoing swelling during the rapid heating. Such swelling is particularly noted in caking type coals. The swelling of caking coals upon heating has been studied and is referred to in "Some Relations in Rank and Rate of Heating to Carbonization Properties of Coal", J. S. Dulhunty and B. L. Harrison, Fuel, 32 (1953) at pages 441 et seq, and further in "Coal Typology —Chemistry —Physics —Constitution", D. W. Van Krevelen, Elsevier Publishing Company, New York 1961, at pages 263 et seq.

In U.S. Pat. No. 2,131,702 Berry disclosed a process for making solid carbonized fuel, such as briquettes, from ground coal and a binder material utilizing very slow heating of the briquettes in non-fluidized beds with a hot non-reactive flue gas. This procedure minimized swelling of the briquettes and thereby maintained adequate strength and smooth surface during devolatilization.

Because of their low density, the hot fine coal particles are difficult to retain in the reaction zone when it is operated under fluidizing conditions. The result has been that a significant portion of the coal particle fines are carried out of the gasifier in the product gas stream along with some tars that are evolved during coal heating and gasification. This combination may cause plugging difficulties in the effluent conduits, resulting in frequent shutdowns of the process. Use of a longer free-fall section for heating the coal particles above the gasification zone has not been successful in overcoming such swelling and carryover problems. Although Jequier (U.S. Pat. No. 2,772,954) has disclosed a process for gasification of various type coals in multiple-beds, he utilizes continuous transfer of the particulate coal from the upper to lower beds, which involves quite rapid heating of the incoming coal particles to the average temperature of the coal in each bed. Furthermore, he operates his top bed at a sufficiently high temperature (500° C) to avoid the formation of tars therein.

The gasification of coal encounters added difficulties when caking type coals are used. The caking type coals tend to agglomerate as well as swell when subjected to the high temperatures employed in gasification, and cause handling problems.

Non-caking coals are of the anthracite and semianthracite types and caking or agglomerating coals are usually of the bituminous types described by the Committee on Chemical Utilization of Coal in "Chemistry of Coal Utilization", John Wiley & Sons, Inc., New York, Volume 1, 1945, pages 183 et seq and also by P. J. Wilson and J. H. Wells in "Coal, Coke and Coal Chemicals", Chemical Engineering Series, McGraw-Hill Book Company, Inc., New York 1950, pages 47 et seq.

Such problems in the gasification of various coals have made it difficult to develop a gasification process that can adequately handle the various types of coals, and especially the swelling type caking coals, to produce a clean fuel gas product.

SUMMARY OF THE INVENTION

It is an object of the present invention to provide a coal gasification process for producing fuel gas which may be operated for extended periods of time without substantial carryover of particle fines or deposition of tars in the gasifier outlet conduits.

It is another object of this invention to provide a coal gasification process wherein the coal particles are heated slowly in a multiple-zone gasifier to minimize swelling of the particles and to retain them in the gasifier, while condensing substantially all tars that are not liquid at ambient temperature on the coal particles in the uppermost zone of the gasifier. In the practice of the invention a process is employed for gasifying particulate coal in a multi-zone counter-current flow gasifier to produce a gaseous hydrocarbon fuel product. The coal enters the gasifier at a temperature between ambient and about 600° F where it is treated by contacting it in a low temperature first zone with a hot reactive gas stream from a second higher temperature zone while maintaining a coal heating rate in each heating zone at between about 10° and 200° F per minute to prevent substantial swelling and thermal disintegration of the coal particles during heating. After the coal has been further slowly heated to about 600° to 800° F, is past the heated particulate coal from the first zone to the adjacent second zone for further heating of the coal and hydrocracking of tars derived therefrom. In the intermediate zones, the coal is raised in temperature to about 1200° to 1600° F and thereafter treated by passing the heated particulate coal to a final gasification zone for high temperature gasification to produce a reactive heating gas. Hot gas containing tar vapor from the final gasification zone is passed countercurrent to the coal in the first and intermediate zones, whereby the tar evolved is substantially condensed and retained on the low temperature coal particles in the cooler zone. Char and ash by-product are recovered from the gasification zone and a fuel gas effluent product is recovered from the first zone.

It is a further object to provide a coal gasification process in which a multiple zone pretreater is combined with the gasifier to provide for the preferred overall slow heating of swelling-type caking coals from ambient temperature through pretreatment to a final gasification temperature of about 1800° F.

Other objects will be apparent from the description herein and the drawings.

BRIEF DESCRIPTION OF THE DRAWINGS

FIG. 1 is a schematic drawing of an improved coal gasification system utilizing a multiple-zone pretreater and multi-zone gasifier shown in vertical cross-section view.

FIG. 2 is a schematic drawing of a similar coal gasification system wherein the product gas is scrubbed oxygen. The oxygen being supplied at 16 should not exceed about 1 SCF of $O_2$/lb of coal processed and preferably 0.4 to 0.7 SCF/lb of coal processed. More specifically, the coal is first introduced into the fluidized bed 14 where it is slowly heated to about 200° F by the upflowing gas passing through perforated plate 15. The heated coal is then passed via downcomer 18 and control valve 19 to the intermediate bed 20 for further heating therein under fluidized conditions maintained by the gas passing upwardly through perforated plate 21. Similarly, coal in bed 20 is heated slowly to an intermediate temperature of about 400° F and is then passed through downcomer 22 and control valve 23 to the bottom bed 26 for final heating therein to about 800° F by the gas passing upwardly through perforated plate 27. Only a portion of the pretreated coal is then withdrawn from the bottom bed 26. An inventory of pretreated coal should be maintained in the bottom bed 26 to provide for thermal balance between the exothermic endothermic reactions in the bed.

Gas is withdrawn from the pretreater at 30 and can be used as a fuel gas or can be further processed as desired. The coal heating rate achieved in these beds will depend upon the coal residence time in each bed, and the flow rate and oxygen content of the upflowing gas. Preferably, three to four fluidized beds should be used in the pretreater unit with the coal being slowly heated to the desired temperature in each bed and then dumped batchwise into the next lower bed.

Although the transfer of coal in the pretreater from the top bed to the lower beds has been shown and described as a preferred intermittent type process because of its greater degree of control, it is contemplated that for some types of coal having relatively low swelling characteristics the inter-bed transfer process may be made continuous. If the continuous transfer of coal is used, downcomers 18 and 22 would be extended to the upper surface of each respective fluidized bed to prevent the uncontrolled dumping of the coal in each bed to the bed immediately below. A continuous operation would of necessity require substantially more beds than a batch process to maintain the same slow average rate of heating.

After the coal has been pretreated by slow heating to between 600° to 800° F, it is withdrawn through valve 31 and passed through conduit 32 to storage bin 34 where it can be temporarily retained to provide adequate control of coal feed rates into the gasifier unit 40. The coal can be passed to weighing bins (not shown) and is then introduced by dense phase transport through conduit 38 into the uppermost zone of the multiple zone gasifier 40.

Gasifier reactor 40 comprises in this embodiment three fluidized beds arranged vertically in series and equipped with downcomer conduits having control valves therein suitable for transferring the hot particulate coal from the uppermost to the lowermost bed. Pressurized steam and oxygen are introduced at 42 into the lowermost bed where they serve to gasify the coal therein and resulting hot reactive gases pass upwardly through the fluidized beds located above. The oxygen content in stream 42 should preferably be such that the temperature in the bottom bed does not exceed the ash softening point of the coal, thereby facilitating removal of the resulting ash. Product gas is withdrawn off the top of the gasifier 40 through conduit 44. This gas may be subjected to subsequent separation for removal of any entrained oils or coal fines at 74 and may be further treated to provide a synthetic natural gas.

The particulate coal in uppermost bed 46 is fluidized by the gas passing upwardly through perforated separator plate 45 at sufficient velocity, at least about 0.2 ft/sec. superficial velocity. The temperature of coal bed 46 is controlled such that substantially all the tars in the rising gases that are not liquid at ambient temperature will condense and be retained on the coal particles therein. The temperature is controlled at between about 600° and 800° F preferably by a cooling fluid which passes through passageway 48 located in heat exchange relation with the fluidized bed 46. Such cooling fluid is usually water or steam, although other suitable fluids may be used. Control of the temperature in this uppermost bed to between 600° and 800° F also prevents tars from being evolved from the coal in this bed and passing out in the product gas through conduit 44 and depositing therein.

After the particulate coal has been heated in bed 46 at the desired rate and to the desired temperature, it passes through downcomer 50 via control valve 52 to intermediate bed 54 for further devolatilization therein at higher controlled temperature. Downcomer 50 preferably does not extend into bed 54 to facilitate the coal transfer. In bed 54, the coal is further heated to between about 1000° and about 1400° F by the hot gas passing upwardly through perforated plate 55. The temperature in bed 54 is preferably controlled by passing a suitable cooling fluid through passageway 56 located in heat exchange relation with the bed.

After the coal has been in intermediate bed 54 for a sufficient period of time to heat to the desired temperature and drive off the volatile matter that vaporizes at temperatures corresponding to the temperature of bed 54, the coal is then passed through downcomer 60 and control valve 62 to the lowermost bed 64 supported by perforated plate 65, for the final gasification at between about 1600° and about 1800° F temperature. Downcomer 60 preferably does not extend into bed 64 to facilitate transfer of the devolatilized coal. Structural parts of the lowermost high temperature bed may require cooling to maintain adequate mechanical strength.

Char and ash produced in lowermost bed 64 is withdrawn either periodically or continuously through conduit 66 and valve 68 to lock hopper 70, and then transferred at lower pressure to storage bin 72 where it may be cooled for further use. At least a partial inventory of char is maintained in bed 64 to maintain a balance between the exothermic and endothermic gasification reactions.

It is anticipated that the coal beds would be dumped sequentially commencing with the lowermost bed 64. Because a char inventory must be maintained in lowermost bed 64, this bed will therefore have a greater capacity than the beds above it. Ordinarily, the lowermost bed will hold about twice as much particulate material as the beds above and, therefore, about one half of the material in the lower bed will be dumped, thereby enabling the maintenance of a char inventory as described hereinabove. The bed next above the lowermost bed will then be completely dumped into the lower bed. This sequence will be followed until the upper bed is dumped and fresh particulate coal is passed into the upper bed.

It is preferred to transfer the particulate coal in each bed of the gasifier to the next lower bed intermittently on a batch-wise basis as hereinbefore described. However, the transfer valves and the number of beds may be so adjusted to permit the coal to be transferred to the next lower bed continuously if desired, particularly for coals having minimum swelling tendencies.

It is an important advantage of this invention that the rate at which the particulate coal is heated can be controlled from its initial temperature to the final gasification temperature. Such slow heating limits the thermal expansion of the coal particles, and thus serves to preserve their structural strength and density, particularly in the case of caking coals with observable swelling tendencies. Thus, the tendency for the coal particles to disintegrate in the fluidized beds to form low density fines is greatly reduced, with the result that substantially all the coal particles are retained within the gasifier beds until they are heated and gasified. Furthermore, by limiting the temperature in the uppermost bed of the gasifier to a level at which the tars evolved from the beds below are substantially condensed on the coal particles, such tars are then recirculated within the reactor for hydrocracking and are thus prevented from being carried into the exit conduits and deposited therein, thereby resulting in the gradual plugging of the conduits and shutdown of the process. Because the pretreated coal is somewhat porous, it can substantially absorb such tars without becoming sticky. Therefore, almost no material escapes from the gasifier having a boiling point above the controlled 600° to 800° F temperature of the uppermost bed. Such tars that do pass through the uppermost bed will usually be liquids at normal temperatures, so plugging in the outlet conduit 44 would not occur. However, the temperature of the uppermost bed should not be so low as to cause an accumulation of oils in the bed. Such control of the temperature in the uppermost bed also reduces the gas velocity at that point in the reactor, which further aids in reducing the carryover of fines into exit conduit 44. Also, the temperature of each bed except the lowermost should preferably be controlled such as by a cooling coil located therein or in heat exchange relation with the bed similar to the cooling coil 48 in bed 46.

Although only three beds have been described herein, the number of beds used in the gasifier is dependent upon the type of coal being gasified, the rate at which the heating of the coal is being controlled and the amount of coal being gasified. The temperature of the lowermost bed has been described as between 1600° and 1800° F, however, the final gasification temperature should usually not exceed the ash softening point for the coal being gasified in order to facilitate the removal of char and ash material. This temperature is controlled by the amount of oxygen in the gas entering the lower bed through conduit 42.

If the fluid used in cooling coil 48 in top bed 46 and cooling coil 56 in intermediate bed 54 is water, the resulting steam at 49 and 57 can be combined to provide at least a portion of the pressurized steam required at 42.

While the multiple bed type gasifier disclosed hereinbefore may be used for gasifying non-caking type coals without pretreatment to prevent swelling, its greater advantage and usefulness occurs when it is used on combination with the pretreater unit for processing caking type coals that swell upon heating. Furthermore, while it is preferred that the multiple bed gasifier be used with the multiple bed type pretreater as disclosed herein to provide for heating coal to about 600°–800° F at a slow rate, the gasifier may be used with other types of pretreaters which heat the coal at controlled rates.

Although this multiple-bed gasifier is effective in limiting the carryover of coal fines and tars in product gas stream 44, it is desirable under some conditions to obtain still further reduction of such carryover materials. Accordingly, as shown by FIG. 1, product gas stream 44 can be passed to gas-solids separator 74 for substantial removal of the particulate solids, and from which a cleaned product gas stream is withdrawn at 76. Separator 74 is preferably a centrifugal or cyclone type separator. A solids-containing stream is withdrawn at 78 and returned to gasifier 40. Stream 78 is preferably introduced into lowermost bed 64, at this permits reprocessing the recovered coal particulate solids through the entire multiple bed gasifier unit. Stream 78 is passed through a pressurizing means 80 such as a screw conveyor. If desired, pressurizing means 80 may comprise a venturi unit with gas-solids stream 78 being introduced into the throat section of the venturi, where it is mixed with and conveyed by pressurized gas stream 82. The solids in stream 78 will usually comprise less than about 15% of the coal feed rate and preferably less than about 5% of the coal feed.

If product gas stream 44 contains more tar vapor than desired in addition to some particulate coal solids so as to interfere with operation of centrifugal type separator 74, the stream 44 can be passed instead to a scrubber unit 86, as shown in FIG. 2. A scrubber liquid, comprising water or light hydrocarbon oil, is introduced at 88 and flows downwardly therein countercurrent with the rising gas. A cleaned gas product stream 90 is withdrawn off the top of the scrubber, and a solids-containing liquid stream 92 is withdrawn off the bottom. If stream 88 is water, the tar liquid will collect at an intermediate level in the scrubber unit 86, and can be withdrawn at 94. Slurry stream 92 containing some particulate coal solids, is returned to the gasifier unit 40 as previously described by action of pump 96. If the coal particles are not sufficiently wetted by water in stream 88 to provide for effective scrubbing and removal of coal solids from gas stream 90 in scrubber 86, a light hydrocarbon oil may be used as liquid stream 88 instead of water.

If desired, gas-solids separator 74 and scrubber unit 86 may be provided connected in series, so that the product gas stream passes first to the gas-solids separator and then to the scrubber.

Herein follow examples which set forth the application of the described process in the gasification of coal.

EXAMPLE I

In order to show the effect of pretreatment on coal by slow heating in a fluidized multiple bed pretreater and show the effect of heating rate upon the packed density of the coal, two different grinds of Illinois No. 6 caking type bituminous coal are tested. Each sample is placed in a 2-inch diameter bed, surrounded by an electrically-heated furnace and the temperature is increased at selected rates to about 800° F while passing a gas containing a small percentage of oxygen upward through the sample to fluidize the particulate coal. Results for these samples are given in Table I.

TABLE I

| COAL | Run# FEED | 108/24 1 | 108/20 2 | 108/23 3 | 108/22 4 | FEED | 108/28 5 | 108/33 6 |
|---|---|---|---|---|---|---|---|---|
| PRETREATMENT OF CAKING COALS | | | | | | | | |
| Final Temperature,° F | | 760 | 800 | 810 | 920 | | 800 | 800 |
| Avg. Heating Rate, ° F/Min. | | 32 | 30 | 80 | 85 | | 32 | Instantaneous (> 200) |
| Pretreating Gas | | | | | | | | |
| V% Oxygen | | 10 | 10 | 10 | 10 | | 10 | 2.5 |
| V% Nitrogen | | 90 | 90 | 90 | 90 | | 90 | 97.5 |
| Supervicial Gas Velocity, Feet/sec. | | 0.50 | 0.25 | 0.55 | 0.56 | | 0.5 | 0.5 |
| Packed Density, g/cc | 0.89 | 0.71 | 0.58 | 0.49 | 0.40 | 0.79 | 0.56 | 0.40 |
| Percent of Original Packed Density | 100 | 80 | 65 | 55 | 45 | 100 | 71 | 51 |
| Char Analyses After Heating | | | | | | | | |
| W% Ash | 12.4 | 13.6 | 14.4 | 15.3 | — | 13.5 | 16.5 | 21.0 |
| W% Volatile Matter | 39.6 | 30.3 | 23.1 | 25.4 | — | 40.2 | 22.9 | 22.8 |
| Particle Size: | | | | | | | | |
| U.S. Sieve - 20/50 | 23 | 27 | 32 | 33 | — | 35 | 41 | 53 |
| - 50/100 | 56 | 55 | 54 | 53 | — | 54 | 47 | 43 |
| - 100/200 | | | | | | | | |
| - −200 | 21 | 18 | 14 | 14 | — | 11 | 9 | 4 |

It is observed that the packed density of the pretreated coal particles decreases moderately upon heating to about 800° F at heating rates of 30° to 80° F/minute while exposed to the oxygen-containing fluidizing gas to produce similar devolatilization of the coal. Also, such packed density decreases further if the coal heating rates exceeds about 80° F/minute and if heated to above about 800° F temperature.

EXAMPLE II

In order to show the effect on gasification of coal by slow heating in a fluidized multiple bed gasifier unit, samples of ground Illinois No. 6 coal are heated between specific temperature ranges at varying heating rates while passing an oxygen-containing gas upwardly through the fluidized coal samples. Each sample is placed in a 2-inch diameter bed surrounded by an electrically-heated furnace at an initial temperature, then heated to the higher temperature during a specific length of time, thus providing specific average heating rates. Results of these tests are presented in Table II.

TABLE II

Effect of Coal Heating On Devolatilization And Gasification Of Coal

| | Feed | (105/25) A | (105/26) B | (105/18) C | Feed | (108/36) D | (108/33) E | (108/37) F | (108/39) G |
|---|---|---|---|---|---|---|---|---|---|
| Bed Initial Temp. ° F | | 70 | 70 | 70 | | 70 | 800 | 800 | 1600 |
| Bed Final Temp. ° F | | 1200 | 1600 | 1600 | | 1600* | 800 | 1600* | 1600* |
| Avg. heating Rate ° F/Min | | | | | | | | INSTANEOUS | |
| Ambient - 800° F | | 40 | 35 | 75 | | 30 | (>200) | (>200) | (>200) |
| 800-1200° F | | 14 | 25 | 45 | | 20 | — | 50 | (>200) |
| 1200-1600° F | | — | 20 | 20 | | 14 | — | 25 | (>200) |
| Superficial Gas Velocity, fps | | | | | | | | | |
| at 800° F | | 0.50 | 0.50 | 0.28 | | 0.50 | 0.5 | 0.47 | — |
| at 1200° F | | 0.33 | 0.37 | 0.37 | | 0.50 | — | 0.42 | — |
| at 1600° F | | — | 0.46 | 0.46 | | 0.46 | — | 0.46 | 0.25 |
| Char Analysis W% | | | | | | | | | |
| Ash | 12.4 | 16.9 | 20.1 | 20.2 | 13.5 | 28.6 | 15.7 | 34.0 | 32.5 |
| Volatile Matter | 39.6 | 9.3 | 5.0 | 2.9 | 40.2 | 5.5 | 22.8 | 7.6 | 10.3 |
| Packed Density, g/cc | 0.89 | 0.60 | 0.61 | 0.50 | 0.79 | 0.44 | 0.40 | 0.30 | 0.27 |
| (Percent of Orig. Packed Density) | 100 | 67 | 68 | 56 | | | | | |
| Particle Size | | | | | | | | | |
| U.S. Sieve + 50 | 23 | 31 | 27 | 31 | 35 | 41 | 53 | 36 | 30 |
| 50/100 | 56 | 53 | 51 | 59 | 54 | 40 | 43 | 42 | 48 |
| 100/200 | | | | | | | | | |
| −200 | 21 | 16 | 22 | 10 | 11 | 19 | 4 | 22 | 22 |

*Samples D, F and G were held at 1600° F temperature for appreciable longer period of time than samples B and C.

It is evident that the particulate coal samples being heated from ambient temperature to gasification temperature at slow heating rates, i.e., not exceeding about 40° F/minute, retains greater packed density than those being heated at more rapid rates. Also, the coal samples which are heated to final gasification temperature of 1600° F in multiple steps at slow heating rates (samples B, C, D) retain greater packed density than either that which is pretreated only by heating to 800° F at very rapid rate of 200° F/minute (sample E), or that which is pretreated at rapid heating rate and then further heated at a slow rate (sample F.) Furthermore, the coal sample which is both pretreated and then further heated at the very rapid heating rate (sample G) exhibits the greatest decrease in packed density of the coal particles.

Thus, coal heating rates used in the gasification temperature range are less critical than in the pretreating temperature range. While coal heating rates for pretreating up to about 800° F should be restricted to about 20°-80° F/minute, heating rates of about 30°-100° F/minute may be used for heating from about 600°-1200° F in the gasifier.

EXAMPLE III

The carryover or elutriation of coal fines from a single bed pretreater connected in series with a single bed gasifier is compared to the carryover from a multiple bed pretreater and gasifier in accordance with this invention when operating at the same maximum temperature conditions. The results are set forth in Table III. The results are based on 1270 lb/hr. dry coal feed to the pretreater and 1000 lb/hr. pretreated coal fed to the gasifier.

TABLE III

| | Single Bed System | | Multiple Bed System | |
|---|---|---|---|---|
| | Pretreater | Gasifier | Pretreater | Gasifier |
| Pressure, psig | 400 | 400 | 400 | 400 |
| Temperature, ° F (Max.) | 800 | 1800 | 800 | 1800 |
| Superficial Upward Gas Velocity, fps | 0.6 | 0.4 | 0.6 | 0.4 |
| Coal Elutriation Rate lbs/hr. | — | 203 | 1 | 7.5 |
| Coal Elutriation Rate W% of feed | | 20.3 | 0.1 | 0.8 |

It is seen that the coal particle elutriation rate from the pretreater is negligible, while that from the single bed gasifier is 20.3 wt. percent of feed, as compared with only about 0.8 wt. percent of feed for the multiple bed gasifier.

Although various specific embodiments of the invention have been described and shown, it is to be understood that they are meant to be illustrative only and not limiting. Certain features may be changed without departing from the spirit or essence of the invention. It is apparent that the present invention has broad application to the gasification of caking and noncaking coals. Accordingly, the invention is not to be construed as limited to the specific embodiments illustrated but only as defined in the following claims.

What is claimed is:

1. A process for gasifying particulate coal in a vertical multi-bed reactor comprising an upper bed, at least one (1) intermediate bed, and a lower gasifying bed, wherein the temperature profile of the reactor increases from the upper bed to the lower bed, and wherein an inventory of particulate coal is maintained in each bed, the coal being sequentially passed to each successively lower bed, comprising the steps of:

(a) passing particulate coal to the upper bed of the gasifier, the gasifier being maintained at a pressure between about 400 and 1500 psig;

(b) passing a fluidizing gas comprising oxygen and steam upwardly through each bed of the gasifier at sufficient velocity to fluidize and heat each bed;

(c) maintaining a heating rate of the coal in each bed of the gasifier at a rate between about 20° and 100° F per minute, whereby swelling and thermal disintegration of the particulate coal is minimized, (d) maintaining the coal inventory in the uppermost bed of the gasifier at a temperature between about 600° and 800° F;

(e) transferring the coal from the upper bed to the next lower intermediate bed of the gasifier intermittently in batches, wherein the coal is heated to a temperature between 1000° and 1400° F thereby partially devolitilzing the coal, liberating tars and oils therefrom;

(f) condensing the tars carried by the upwardly flowing fluidizing gases on the particulate coal inventory maintained in the upper bed of the gasifier, whereby the tars and oils are substantially hydrocracked upon sequential passage to the intermediate bed;

(g) passing the partially devolitized coal to the lowest bed of the gasifier wherein the coal is heated to a temperature between about 1600° and 1800° F, such temperature not exceeding the ash softening point of the coal, whereby the coal reacts with the fluidizing gas thereby converting the coal into char, byproduct ash and a gaseous product;

(h) removing a portion of the char and byproduct ash from the lowest bed of the gasifier;

(i) removing a gaseous product stream from the upper bed of the gasifier.

2. The process of claim 1 wherein the gasifier comprises between 3-5 beds.

3. The process of claim 1 wherein the heating rate of the coal in each bed is maintained between 20°-50° F per minute.

4. The process of claim 1, wherein the superficial gas velocity of the fluidizing gas is at least 0.2 ft./sec.

5. The process of claim 1 wherein the particulate coal is a caking coal, the process further comprising the step of pretreating the coal with an oxygen containing gas sufficiently hot to heat the coal from ambient temperature to a temperature between about 600° and 800° F at a rate between 10° to 200° F per minute, whereby the coal is rendered substantially non agglomerating prior to passing the coal to the gasifier.

6. The process of claim 1 wherein the heating rate of the coal in each bed is maintained between 20°-50° F per minute and wherein the superficial gas velocity of the fluidized gas is at least 0.2 feet per second.

7. The process of claim 1 further comprising the step of pretreating the coal with an oxygen containing gas sufficiently hot to heat the coal to a temperature between about 600° and 800° F at a heating rate between 10°-200° F per minute whereby the coal is rendered substantially a non-agglomerating prior to passing the coal to the gasifier.

8. The process of claim 5, wherein the pretreating step is a multibed pretreater having at least 3 beds wherein particulate coal is intermittently fluidized by a hot fluidized gas comprising less than about 1.0 standard cubic feet of oxygen per pound of coal upwardly from the last bed to the first bed while the coal passing from the first bed to the last bed, said coal being heated at a rate between 10°-100° F per minute to a temperature between about 600°-800° F.

9. A batchwise process for gasifying particulate coal in a vertical multizone countercurrent flow gasifier having at least three zones comprising an upper zone, at least one intermediate zone and a lower zone, the upper and intermediate zones having heat exchange means therein for maintaining a maximum temperature in each zone, the lower zone having a capacity to treat at least twice as much coal than in each of the upper and intermediate zones, comprising the sequential steps of:

(a) passing the particulate coal to the upper zone of the gasifier, wherein the coal is heated from ambient to a temperature between 600° and 800° F by the fluidizing gas, comprising oxygen and steam flowing upwardly through each zone of the gasifier at sufficient velocity to fluidize and heat the coal in each zone at a rate between 10° and 200° F per minute, whereby swelling and thermal disintegration of the particulate coal is minimized;

(b) passing the heated coal from the upper most zone downwardly to an intermediate zone;

(c) repeating step (a) thereby maintaining an inventory of fresh coal in the upper zone of the gasifier.

(d) heating the coal in the intermediate zone to a temperature between 1000° and 1400° F, at a heating rate between 10° and 200° F per minute by the fluidizing gas moving upwardly through the gasifier, whereby the particulate coal is partially devolitized thereby liberating tars and oils;

(e) passing the tars and oils upwardly through the gasifier to the upper zone substantially condensing the tars and oils on the coal in the upper zone;

(f) passing the partially devolitilized coal from the intermediate zone to the lower most zone;

(g) sequentially repeating steps (b) and (a).

(h) heating the coal in the lowermost zone to a temperature between 1600° and 1800° F whereby the fluidizing gas moving upwardly therethrough reacts with the devolitized coal thereby producing a fuel gas;

(i) removing at least one half of the coal inventory in the lower most zone;

(j) sequentially repeating steps (f), (b) and (a);

(k) recovering a gaseous product stream from the gasifier (l) removing by-product ash from the lowermost zone.

10. A process for the gasification of particulate caking type coal to produce a fuel gas, which comprises:

(a) feeding the coal into the top bed of a multiple bed pretreater at ambient temperature and atmospheric pressure;

(b) passing a gas comprising less than about 1.0 SCF of oxygen per pound of coal upwardly through the beds of said pretreater to heat the fluidize and coal;

(c) heating the coal in each bed of said pretreater at a rate between about 10° and 100° F per minute, whereby the swelling of the coal particles is minimized;

(d) transferring said heated coal downwardly to the next lower bed of the pretreater intermittently in batches;

(e) maintaining the temperature of said coal in the bottom bed of said pretreater at between about 600° to 800° F such that minimum devolatilization of the coal occurs; removing a gaseous product stream from said top bed of said pretreater.

(f) feeding pretreated particulate coal from the bottom of said pretreater to the uppermost bed of a multibed gasifier;

(g) passing fluidizing gas comprising oxygen and steam upwardly through the beds of said gasifier at sufficient velocity to fluidize and heat the beds;

(h) heating the coal in each bed of said gasifier at a rate between about 20° and 100° F per minute;

(i) maintaining the coal in said uppermost bed of said gasifier at a temperature between about 600° and 800° F by indirectly cooling the coal with an external fluid in heat exchange relationship with the bed;

(j) transferring the coal downwardly to the next lower bed of said multibed gasifier intermittently in batches;

(k) heating the coal in the next lower bed to 1000°-1400° F temperature whereby the coal is partially devolitilized thereby liberating tars and oils;

(l) condensing the tars carried by the gases passing upwardly through said gasifier on the pretreated coal in the uppermost bed of said gasifier whereby said tars and oils are substantially hydrocracked upon passage to the next lower bed;

(m) heating the coal in the lowest bed of said gasifier to between about 1600° and 1800° F such that the ash softening point of the coal is not exceeded and char is formed whereby the char reacts with the gas comprising steam and oxygen thereby converting the char into a gaseous product;

(n) removing a portion of said char from the lowest bed of said gasifier so as to maintain an inventory of char in the bed; and (o) removing a gaseous product stream having reduced fines and tars from the uppermost bed of said gasifier (p) removing by-product ash from the lowermost bed of the gasifier.

* * * * *

United States Patent [19]

Suzuki et al.

[11] 4,099,934

[45] Jul. 11, 1978

[54] METHOD FOR MANUFACTURING RESINOID-BONDED GRINDING TOOLS

[75] Inventors: Ikuo Suzuki, Chiryu; Tomoyasu Imai, Kariya; Masato Kitajima, Hekinan; Kazunori Hota, Okazaki, all of Japan

[73] Assignee: Toyoda Koki Kabushiki Kaisha, Aichi, Japan

[21] Appl. No.: 750,439

[22] Filed: Dec. 14, 1976

[30] Foreign Application Priority Data

Sep. 1, 1976 [JP] Japan ..... 51-104395
Jul. 29, 1976 [JP] Japan ..... 51-90611

[51] Int. Cl.[2] ..... C23G 1/02; C23G 1/14

[52] U.S. Cl. ..... 51/295; 51/298 A; 51/309 A; 51/307

[58] Field of Search ..... 51/295, 298, 309

[56] References Cited

U.S. PATENT DOCUMENTS

| | | | |
|---|---|---|---|
| 2,379,544 | 7/1945 | Scutt | 51/298 |
| 2,536,183 | 1/1951 | Jamieson | 51/298 |
| 2,557,047 | 6/1951 | Goepfert et al. | 51/298 |
| 2,943,926 | 7/1960 | Goepfert | 51/298 |
| 3,664,819 | 5/1972 | Sioui et al. | 51/295 |
| 3,854,898 | 12/1974 | Whitney et al. | 51/309 |
| 3,868,232 | 2/1975 | Sioui | 51/295 |
| 3,923,476 | 12/1975 | Roy et al. | 51/295 |

FOREIGN PATENT DOCUMENTS

| | | | |
|---|---|---|---|
| 562,815 | 7/1944 | United Kingdom | 51/298 |

*Primary Examiner*—Donald J. Arnold
*Attorney, Agent, or Firm*—Oblon, Fisher, Spivak, McClelland & Maier

[57] ABSTRACT

Resinoid-bonded grinding tools are prepared by applying a liquid thermosetting resin to the circumferential surface of a disc-like base member and then after coating metal-coated abrasive grains with a liquid thermosetting resin, mixing the coated grains with a powdered thermosetting resin. The mixture of the coated grains and the powdered thermosetting resin is press-formed upon the surface of the base member and then thermally set by heating.

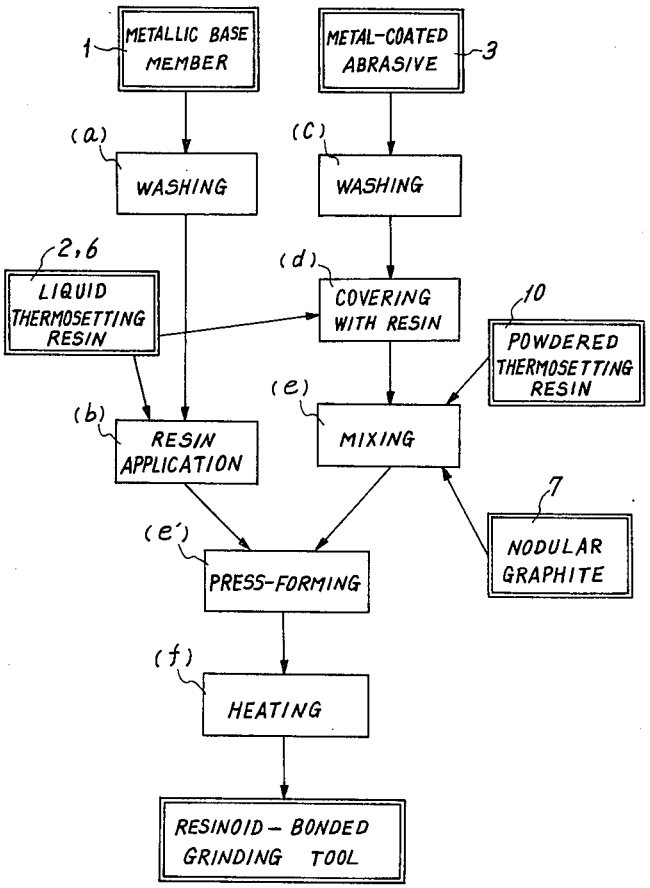

11 Claims, 5 Drawing Figures